US011701541B1

(12) United States Patent
Jacobson

(10) Patent No.: US 11,701,541 B1
(45) Date of Patent: Jul. 18, 2023

(54) FREE-WEIGHT LIFTING AND SUPPORT SYSTEM USED BY A WEIGHTLIFTER

(71) Applicant: John T. Jacobson, L'Anse, MI (US)

(72) Inventor: John T. Jacobson, L'Anse, MI (US)

( * ) Notice: Subject to any disclaimer, the term of this patent is extended or adjusted under 35 U.S.C. 154(b) by 0 days.

(21) Appl. No.: 16/837,991

(22) Filed: Apr. 1, 2020

Related U.S. Application Data

(60) Provisional application No. 62/921,838, filed on Jul. 9, 2019.

(51) Int. Cl.

| | |
|---|---|
| ***A63B 21/072*** | (2006.01) |
| *A63B 21/00* | (2006.01) |
| *A63B 21/062* | (2006.01) |
| *A63B 21/078* | (2006.01) |
| ***A63B 21/075*** | (2006.01) |

(52) U.S. Cl.
CPC ..... *A63B 21/0724* (2013.01); *A63B 21/075* (2013.01); *A63B 21/4035* (2015.10); *A63B 21/4043* (2015.10); *A63B 21/0004* (2013.01); *A63B 21/078* (2013.01); *A63B 21/0626* (2015.10)

(58) Field of Classification Search
CPC ..... A63B 21/0004; A63B 21/0626; A63B 21/0724; A63B 21/075; A63B 21/078; A63B 21/4035; A63B 21/4043
See application file for complete search history.

(56) References Cited

U.S. PATENT DOCUMENTS

| | | | | |
|---|---|---|---|---|
| 4,274,628 | A | 6/1981 | Hoagland | |
| 4,360,198 | A * | 11/1982 | Waulters | A63B 21/078 482/106 |
| 9,095,742 | B2* | 8/2015 | Henniger et al. | A63B 21/0724 |
| 10,245,461 | B2* | 4/2019 | Bruni et al. | A63B 21/0783 |
| 11,007,396 | B2* | 5/2021 | Petrucci | A63B 21/0004 |
| 2006/0100075 | A1* | 5/2006 | Harsh | A63B 23/0405 482/142 |
| 2013/0065738 | A1* | 3/2013 | Henniger et al. | A63B 23/0405 482/104 |
| 2015/0087485 | A1* | 3/2015 | Kimura | A63B 17/00 482/104 |
| 2017/0266480 | A1* | 9/2017 | Bruni et al. | A63B 21/062 |
| 2019/0269957 | A1* | 9/2019 | Petrucci | A63B 21/4039 |

OTHER PUBLICATIONS

SOLOSTRENGTH.COM, SoloStrength® Bodyweight Functional Training Equipment on line advertisements, located at this link: www.solostrength.com. and this linked content printed off the internet on Sep. 3, 2020, and attached hereto, learned of by Applicant in the United States after Jul. 9, 2019, and before Apr. 1, 2020.

* cited by examiner

*Primary Examiner* — Joshua Lee
(74) *Attorney, Agent, or Firm* — Amundsen Davis, LLC

(57) ABSTRACT

A free-weight lifting and support system used by a weightlifter. The system includes a left side support and a left free-weight holder. It also includes a right side support and a right free-weight holder. It further includes a lifting bar, the lifting bar located between the left and right side supports and separating the left and right side supports from each other, and the lifting bar is vertically adjustable relative to the left and right side supports at the same time. The left side support is connected with the right side support via at least the lifting bar such that the lifting bar, the left side support and the right side support are together simultaneously liftable from a ground position to a lifted position by the weightlifter and safely back to the ground position by the weightlifter.

19 Claims, 8 Drawing Sheets

FREE-WEIGHT LIFTING AND SUPPORT SYSTEM USED BY A WEIGHTLIFTER

CROSS-REFERENCE TO RELATED APPLICATION

This application claims the benefit of U.S. Provisional Application No. 62/921838, filed Jul. 9, 2019, and titled: SAFETY WEIGHT.

TECHNICAL FIELD

This invention relates to equipment for use in weightlifting and preferably for use of free-weights. In particular, the system is designed to be a safe and versatile piece of free-weight equipment for weightlifters who do bench press, shoulder press, squat, deadlift, dips, pull-ups, bicep curls, or just about any other lift that can be done with a barbell or free-weight.

BACKGROUND

Traditional barbell or free-weight equipment can be used for basic, essential exercises performed by lifters of all ages and ability levels in gyms around the world. There are inherent dangers that exist when doing many customary lifts with existing free-weights and weight bars. The danger has to do with the way that these lifts have been, and are currently being performed, and it has put the lifter at risk. The problem that each lifter really faces is the reality that the bar could potentially fall on them and crush them each time they perform a lift. Basically, the more weight a lifter is attempting on a lift, the greater the risk can be. Because of these risks, most free-weight lifts have required at least one other person to be present to spot (watch very closely) the lifter in case they cannot finish their intended number of repetitions due to muscle fatigue, lack of balance, using too much weight that they can't handle, or other reasons. As a result of the danger involved in using free-weights there have been numerous deaths and injuries every year throughout the world when the bar falls and kills the lifter.

When a lifter gets in trouble while performing one of these lifts in the standard way with the standard equipment, their ultimate safety can be decided by their spotter's ability to save them from serious injury. If the lifter does have a spotter watching them while they are performing these lifts, the spotter's job is sometimes to catch the bar to prevent it from falling on their upper torso including their neck or face, or other body parts. As you might imagine, these lifts can result in serious harm including up to death. Even if the inability to finish a lift does not result in an injury, and the spotter helps them finish the lift without injury, the trauma and fear caused by struggling to finish a lift and the realization of what might have happened to them if the bar had fallen on them, can result in a poor, inefficient lifting experience, and a great amount of psychological fear that ensues each time a lift is performed. Of course, the fear and risk rise greatly when a lifter chooses to do the lifts listed above on their own with no one to spot them. Unfortunately, many lifters do choose to lift on their own which is very dangerous.

SUMMARY

To address the need for a piece of equipment to be used with free-weights that is safer and/or more versatile and/or more accommodating to different weightlifter needs, there is provided my system. In one embodiment, there is a free-weight lifting and support system used by a weightlifter. The system includes a left side support having a left base end, a left top end and a left free- weight holder. It also includes a right side support having a right base end, a right top end and a right free-weight holder. Further, the system includes a lifting bar having a bar left end and a bar right end. The lifting bar is located between the left side support and the right side support and separating the left side support from the right side support. The lifting bar is vertically adjustable between the left base end and the left top end of the left side support at the same time as the lifting bar is vertically adjustable between the right base end and the right top end of the right side support. The left side support is connected with the right side support via at least the lifting bar such that the lifting bar, the left side support and the right side support are together simultaneously liftable from a ground position to a lifted position by the weightlifter and safely back to the ground position by the weightlifter.

In another embodiment there can be an alternate free-weight lifting and support system used by a weightlifter. This system includes a left side support having a left base end, a left top end and a left free- weight holder. It also includes a right side support having a right base end, a right top end and a right free-weight holder. Further, it includes a lifting bar having a bar left end and a bar right end. The lifting bar is located between the left side support and the right side support and separating the left side support from the right side support. The lifting bar is vertically adjustable between the left base end and the left top end of the left side support at the same time as the lifting bar is vertically adjustable between the right base end and the right top end of the right side support. A base frame can be attached to the left side support and the right side support and aiding in separating the left side support from the right side support. The left side support can be connected with the right side support via the base frame and lifting bar such that the lifting bar, the left side support and the right side support are together simultaneously liftable from a ground position to a lifted position by the weightlifter and safely back to the ground position by the weightlifter, and preferably where safely back to the ground position by the weightlifter is even when a strength of the weightlifter fails.

In some embodiments there are features directed to the base frame configuration, for example, it being c-shaped, or a portion of it extending away from the left side support and the right side support, or the frame being attached to the left base end and to the right base end, and when done so, it is preferably rigidly connected.

Also described herein, are embodiments directed to the lifting bar and it being, for example, adjustably attached to the left side support and right side support adjacent the bar ends. Further in this regard, the bar ends may slidingly engage the respective side support between the base end and the top end. As another example, the lifting bar can be readily removable from the left and right side supports for enhanced versatility of the system.

In yet other embodiments also directed to the lifting bar, there can be the lifting bar having a u-shaped portion, or being longitudinally adjustable. When longitudinally adjustable, i.e. adjustable along its length, this can be the bar left end being slidingly adjustable relative to the left side support and the bar right end being slidingly adjustable relative to the right side support and thereby the u-shaped portion can be expanded and contracted. The he u-shaped portion may also be rotatable from a first fixedly-adjustable position to a second fixedly-adjustable position, when desired. Alternately, the fixedly-adjustable turned off so the bar is freely rotatable 360 around its longitudinal axis, when that is desired by the weightlifter.

BRIEF DESCRIPTION OF THE DRAWINGS

The system may be more completely understood in consideration of the following detailed description of various embodiments of the system in connection with the accompanying drawings, in which.

Figure 1:
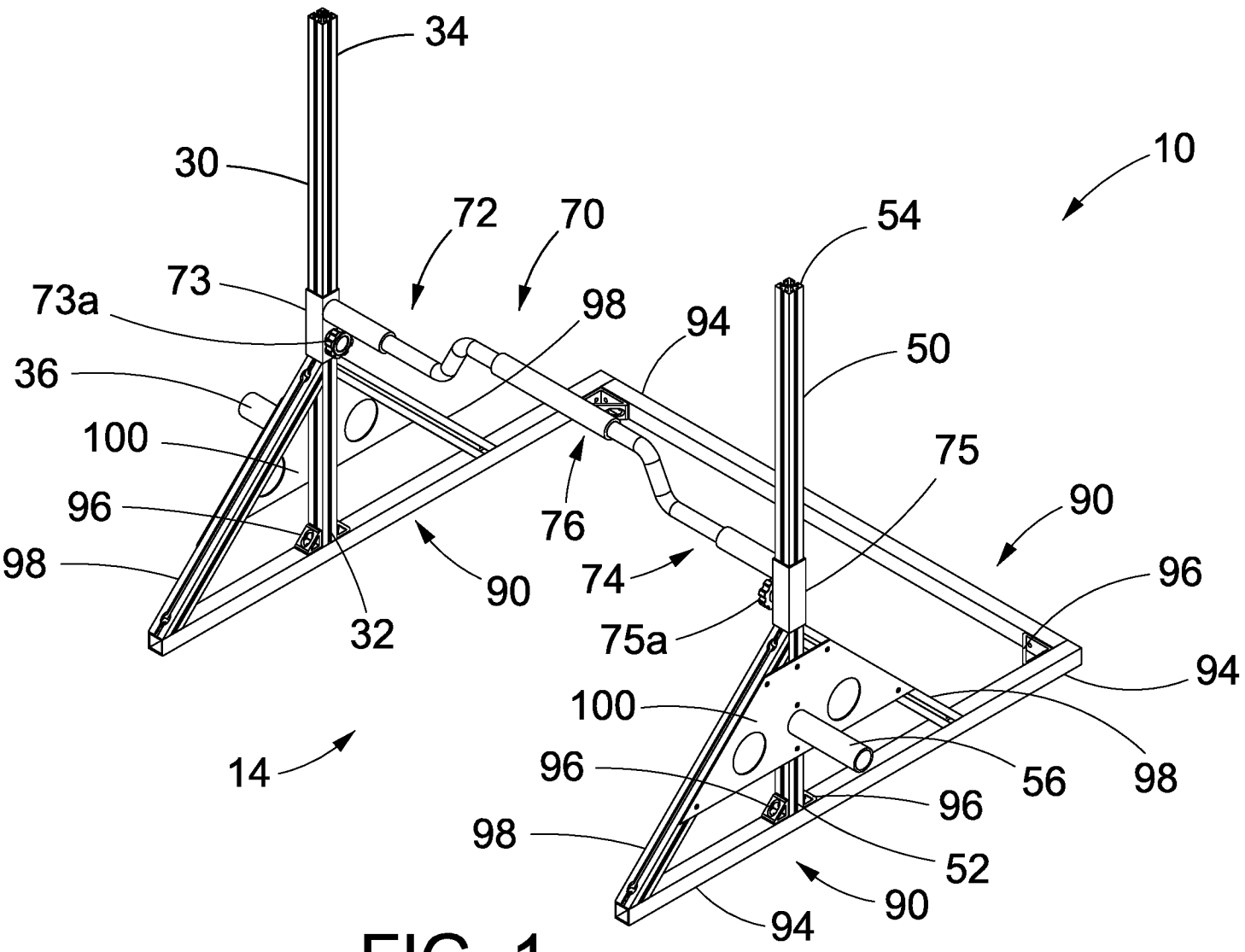
FIG. 1 is a perspective view of a free-weight lifting and support system used by a weightlifter.

The drawings show some but not all embodiments. The elements depicted in the drawings are illustrative and not necessarily to scale, and the same (or similar) reference numbers denote the same (or similar) features throughout the drawings.

DETAILED DESCRIPTION

Figure 2:
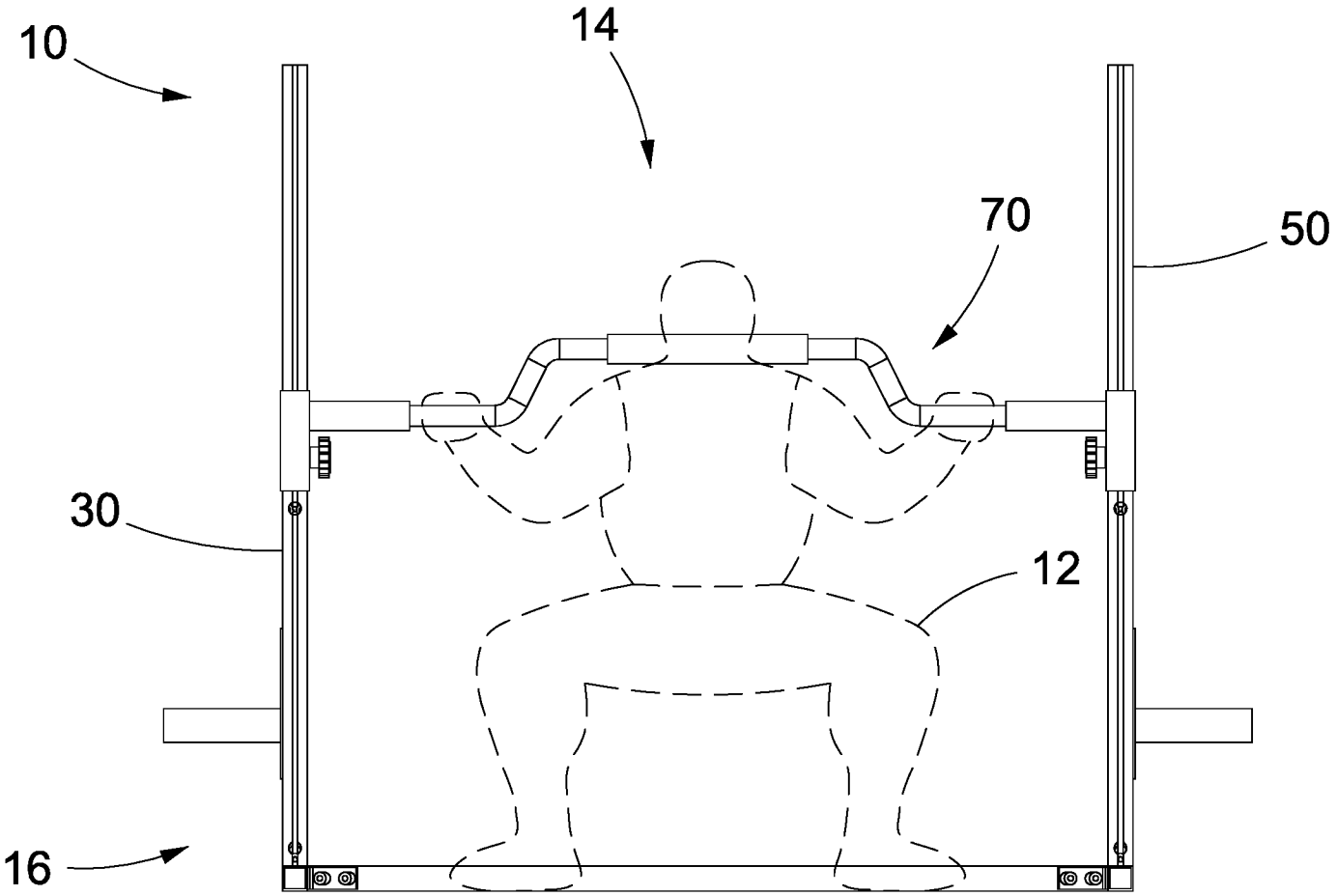
FIG. 2 is a front view of that seen in FIG. 1, with a weightlifter ready to engage the free-weight lifting and support system in its ground position.

In accordance with the practice of at least one embodiment of the system, as seen in FIGS. 1-6 for example, there is a free-weight lifting and support system used by a weightlifter 12. System 10 includes a left side support 30 having a left base end 32, a left top end 34 and a left free-weight holder 36. The system also includes a right side support 50 having a right base end 52, a right top end 54 and a right free-weight holder 56. Further, system 20 includes a lifting bar 70 having a bar left end 72 and a bar right end 74. The bar 70 is located between the left side support 30 and the right side support 50 and separating the support 30 from the support 50. The lifting bar 70 is vertically adjustable between the left base end 32 and the left top end 34 of the left side support at the same time as the lifting bar 70 is vertically adjustable between the right base end 52 and the right top end 54 of the right side support. The left side support 30 is connected with the right side support 50 via at least the lifting bar 70 such that the lifting bar 70, the left support 30 and the right support 50 are together simultaneously liftable from a ground position 16 (as seen in FIGS. 1, 2, and 4-6) to a lifted position 18 (as seen in FIG. 2) by the weightlifter 12 and safely back to the ground position 18 by the weightlifter. As explained further below, moving the lifting bar 70, the left support 30 and the right support 50 simultaneously together safely back to ground position 16 by the weightlifter after being in the lifted position 18, preferably happens even when a strength of the weightlifter fails, for example, if a knee of the lifter gives out under pressure of the weight on the weightlifter in the squat exercise. As another aspect possible for the system, certain parts can be, preferably, configured longitudinally. For example, each of the left side support, the right side support and the lifting bar can be configured longitudinally such that each has a length dimension that is greater than a width dimension. This is generally as seen in the figures and related discussions herein.

Figure 7:
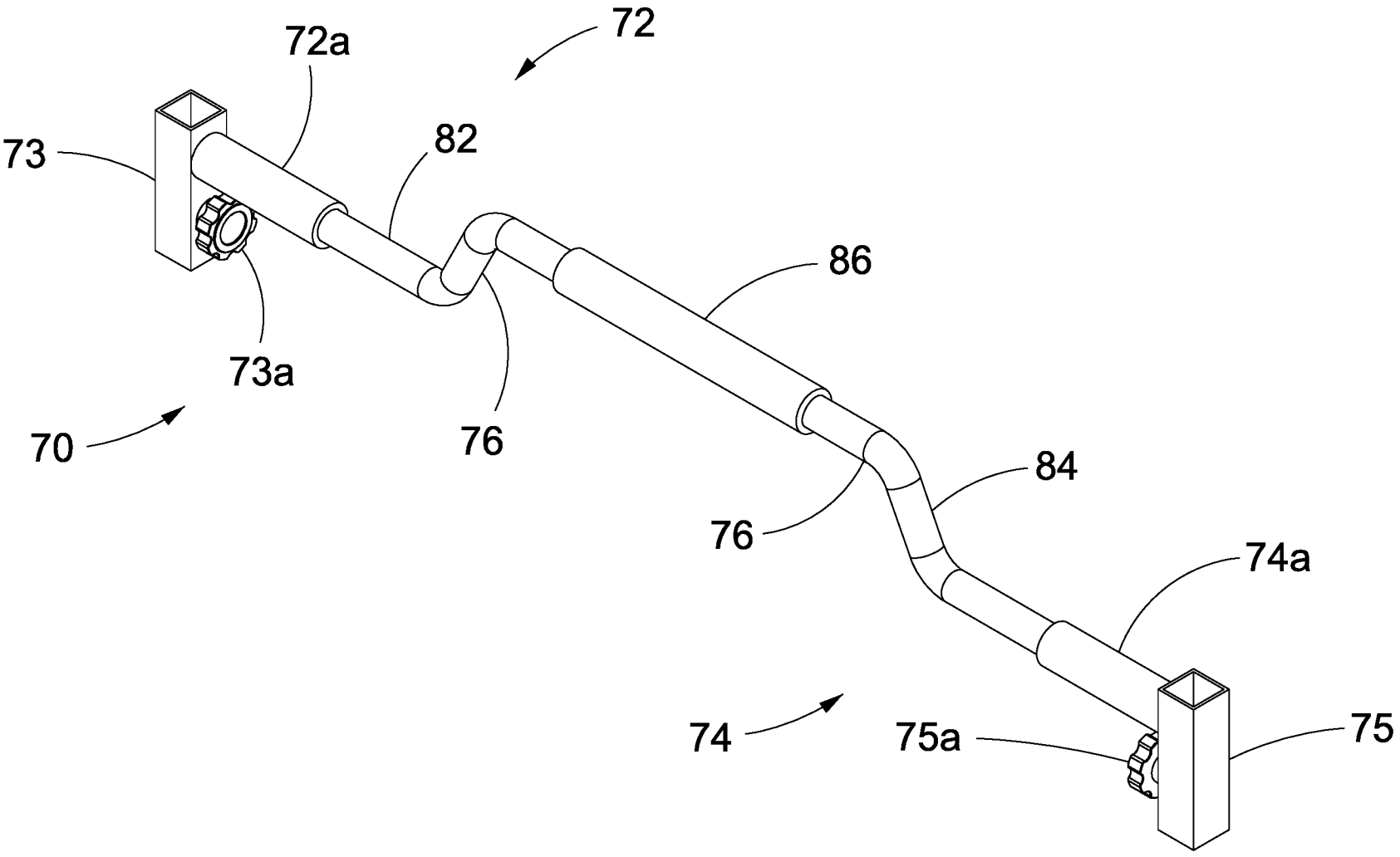
FIG. 7 is an enlarged perspective view of the lifting bar seen in FIG. 1.
Figure 9:
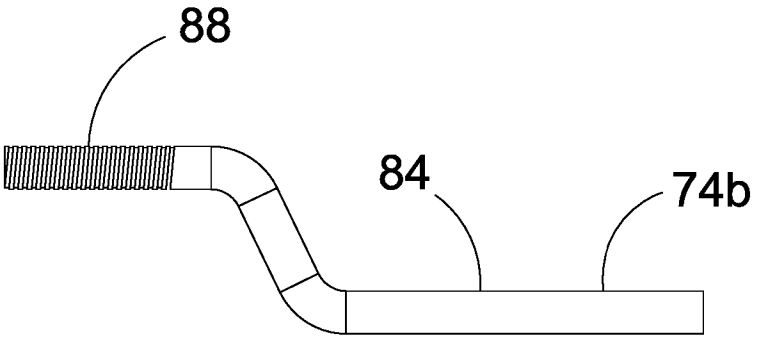
FIG. 9 is a front view of a right side portion of the lifting bar seen in FIG. 7.
Figure 8:
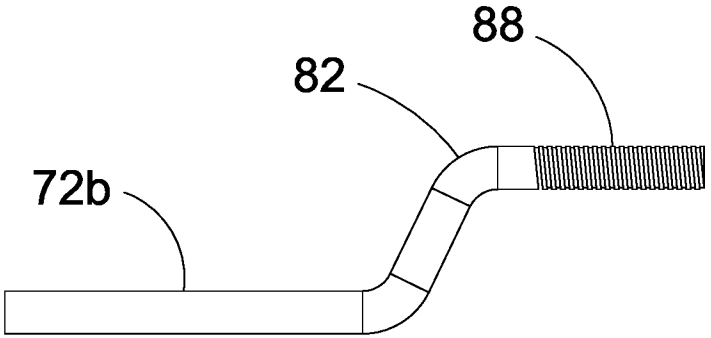
FIG. 8 is a front view of a left side portion of the lifting bar seen in FIG. 7.

Now, also in reference to FIG. 7, in another embodiment, the lifting bar 70 can be adjustably attached to the left side support 30 adjacent the bar left end 72, and bar 70 can be adjustably attached to the right side support adjacent the bar right end 74. This adjustably attached relationship can be the bar left end 72 slidingly engages the left side support 30 between the left base end 32 and the left top end 34, for example, with a bar left end side support sheath 73. Similarly in this regard, the adjustably attached relationship can be the bar right end 74 slidingly engages the right side support 50 between the right base end 52 and the right top end 54, for example, with a bar right end side support sheath 75. Sheaths 73, 75 are sized to relatively snuggly fit around respective supports 30, 50 yet also be able to slide along the length of the same. And, the sheaths, respectively, can include a screw stop 73*a* and 75*a*, to selectively lock the sheaths 73, 75, to supports 30, 50 and thereby the bar ends 72, 74 in place as desired for use of the system 10 as described further herein. As yet another aspect of the system here, the lifting bar can be readily removable from the left and right side supports by sliding the bar left end up and over the left top end while sliding the bar right end up and over the right top end. In this way, the lifting bar can be changed out with a different bar, when desired, and the lifting bar then easily put back in place by sliding the bar left end on and down past the left top end while sliding the bar right end on and down past the right top end to the desired place between the ends 32,34 and 52,54, respectively, and locked in place relative to the supports for use of the system as desired by a weightlifter.

In still another embodiment of the system, at least one of the left free-weight holder 36 and the right free-weight holder 56 can be attached to its respective side support 30, 50 such that the at least one, and preferably both, of the left free-weight holder and the right free-weight holder extends away from a space 14 located between supports 30, 50. Still further, for example, at least one, and preferably both, of the holders 36, 56 can be a pin-like structure. In use, traditional free-weight plates (not shown) can be placed on the holders via the structures and as many as needed for the desired weightlifting amount.

In yet another embodiment, the system may include a base frame 90 attached to the left side support 30 and the right side support 50 and aid in separating the supports 30, 50. For example, the base frame can be c-shaped (as seen in FIGS. 1-6) and a portion 94 of it may extend away from the left side support and the right side support. Further, preferably base frame 90 is attached to the left base end 32 and to the right base end 52. Still further, the left side support 30 can be connected with the right side support 50 via at least base frame 90, and if so connected, preferably such is rigidly connected. In another aspect, base frame 90 may include joint supports 96, angle supports 98, and/or plate supports 100, all of which can enhance, or alternately provide, stability for the supports 30, 50, respectively, if desired.

Figure 6:
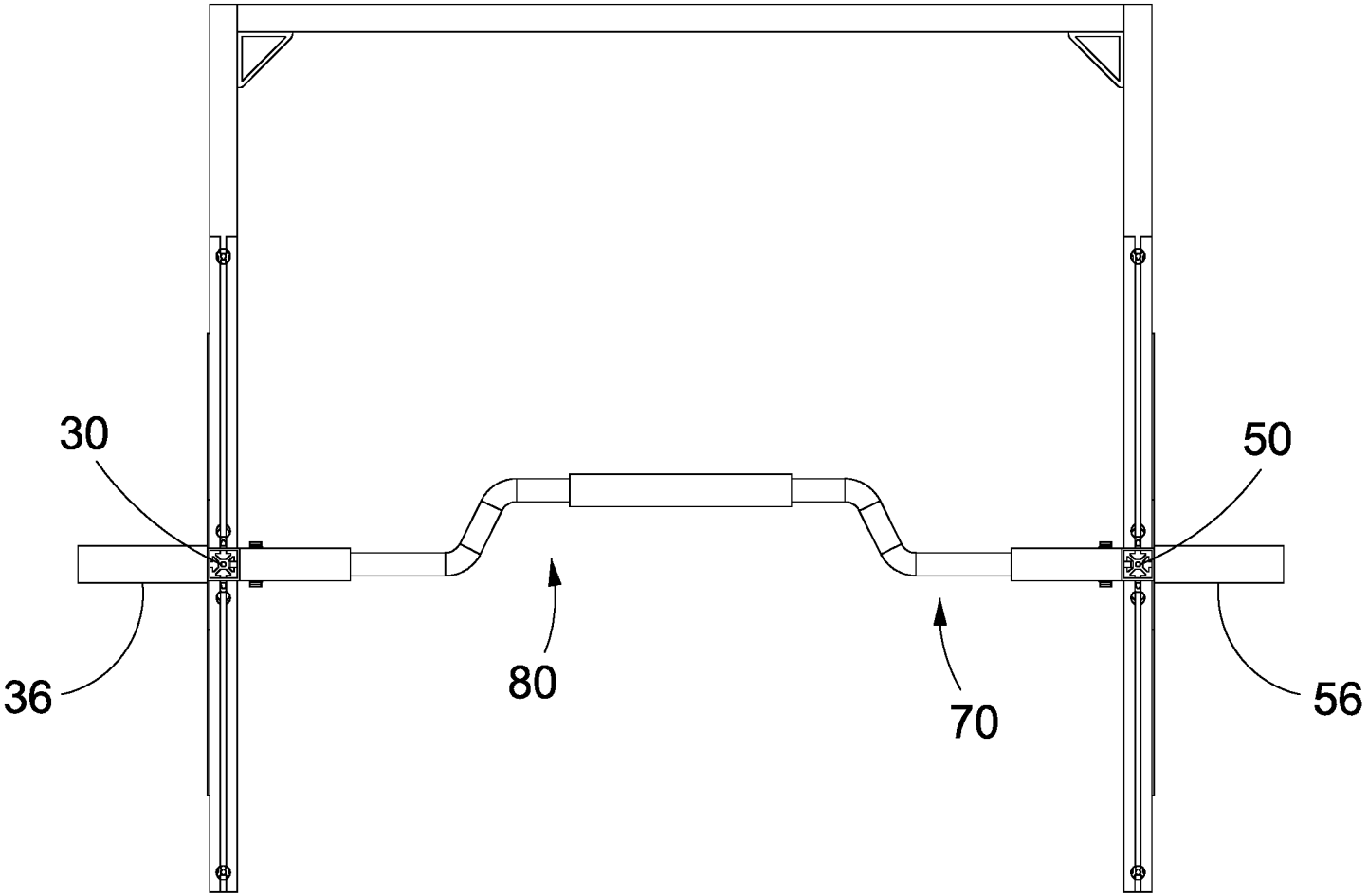
FIG. 6 is a top side view similar to that seen in FIG. 1, but now with the lifting bar rotated from a first fixedly-adjustable position to a second fixedly-adjustable position.
Figure 10:
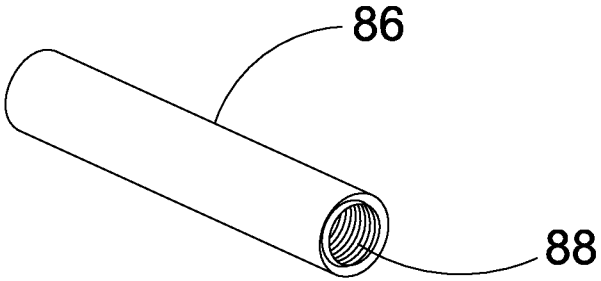
FIG. 10 is a front view of a center portion of the lifting bar seen in FIG. 7.

Now, in reference to FIGS. 7-10 and other embodiments, the lifting bar can have a u-shaped portion 76 located between the bar left end 72 and the bar right end 74. In one aspect, the lifting bar can be longitudinally adjustable. In another aspect, longitudinally adjustable can be the bar left end 72 being slidingly adjustable relative to the left side support and the bar right end 74 being slidingly adjustable relative to the right side support and thereby the u-shaped portion can be expanded and contracted. For example, this can be attained by a bar left shaft 82 (FIG. 8) and a bar right shaft 84 (FIG. 9) that both fit together with a bar center collar 86 (FIG. 10). This fitted relationship could be by threaded areas 88 so that screwing center collar 86 one way causes shafts 82, 84 to get closer to each other and bar 70 to thereby contract the u-shaped portion and screwing center collar 86 the opposite way causes shafts 82, 84 to get further apart from each other and bar 70 to thereby expand u-shaped portion 76, all as desired by the user and explained further below. In still another aspect, lifting bar 70 can be angularly adjustable such that the u-shaped portion 76 can be rotated from a first fixedly-adjustable position 78 (as seen in FIGS. 1-5) to a second fixedly-adjustable position 80 (as seen in FIG. 6), or a variety of other fixedly-adjustable positions (not shown) that the u-shaped portion can be rotated angularly about. For example, this can be achieved by a notching system internal to and by the collars 72*a*, 74*a* with their respective shafts 72*b*, 74*b*, as would be known to do by one of ordinary skill in the art in combination with the teachings about the system here. Alternately, for certain types of lifts like a squat, it may be desired to have the lifting bar, and in particular the u-shaped portion 76, be freely rotatable 360 degrees about is longitudinal axis. This can be achieved by turning off the fixedly-adjustable positions feature, as would be known to do by one of ordinary skill in the art in combination with the teachings about the system here.

Without limiting the system to any particular features or advantages, the inventor has found a variety of ways the system 10 can be safer and/or more versatile and/or more accommodating to different weightlifter needs. For example, the weights can be put on posts or pin-like structures near the floor so this alone can improve safety. More significantly, as long as the system is used properly, the system can prevent the lifting bar from ever falling down and crushing the lifter. When the lifting bar is set at a height for a particular lift, it will go no lower than that height when the lift is being performed. Therefore, if the lifting bar is set at the proper height before the lift is performed, that is the lowest height it will go to during the lift and no one should ever get crushed by the lifting bar or other part of the equipment.

As another example, the dual-functionality of the system can create a 50% reduction (or more) in space needed to do the squat and bench press separately. When doing the squat, a space up to a 7 foot by 5 foot square is usually required. This is not including the additional space required to move around a traditional squat rack. Then a lifter will need the space to set up a bench press, which will require a space that is about 7 feet by 6 feet (again not including the additional space required to move around the traditional bench press). With my system, you are using most of the same equipment and space to do both the squat and bench in less space than is required by doing one of them with existing equipment, and thus one can see there can be significant space savings of over 50%. The space savings can further increase when considering the versatility of the system and some of the other exercises that can be performed with it.

As yet another example, the free-weight lifting and support system can have dual-function capability in that it can be used as a bench press, which is a classic staple of building upper body strength, and then it will transform easily and quickly to be used for the squat, which is a classic staple lift for building lower body strength and/or the shoulder press lift (among many others). This is an amazing benefit for individuals that want to lift alone and perform these essential upper and lower body lifts and have limited space available. It can also be used to do the shoulder press, curls, pull-ups, military press, dips, deadlifts and just about any other free-weight lift that is done with a barbell.

As still another example, unfortunately, lifters do not always use a spotter to keep an eye on them while they are lifting. Most people do not want to bother someone and ask for help, this is just human nature for some, and others just don't acknowledge the risks involved. Still others just simply prefer to lift alone. This prevents lifters from maximizing their lift because doing the customary bench press and squat requires the lifter to stop short of pushing themselves on their last few repetitions due to fear of dropping the bar on themselves. When the innovative system here is used correctly, there is really no possibility that the weight will fall on top of the lifter, essentially eliminating the need for a spotter. With my system used properly, e.g., to do the squat, the inherent safety design features provided allow the lifter to perform this lift without a spotter but yet still push themselves to the very last repetition without fear of injury from the bar falling on them.

Yet still another example, live weights and safety historically have not usually been synonymous with one another, and many machines have attempted to satisfy the safety needs and provide the lifter with the feeling of live weights. However, if you ask the opinion of most lifters, live weights are usually preferable over a machine. The safety provided by a machine just doesn't provide the same results and feel that live weights provide. My system has solved this problem on several essential upper and lower body lifts.

As another example, the system has adjustability built in to allow for certain width and height adjustments of the horizontal bar depending on the exercise desired. The lifter can also adjust it to do chin-ups (or pull-ups) as well by adding vertical column extensions (not shown) to both side supports. This, in effect, allows the lifter to more easily customize the equipment to fit their body-size needs. There can also be the ability to rotate the lifting bar itself to create the ability to do other lifts for added comfort and functionality, as discussed previously.

And yet another example, my system can be collapsible (not shown) and when the lifter is finished using it, it can be disassembled to be lying flat and fit under most beds. This can be a great feature for those who don't have the space to store it, and want to put it out of sight when it is not being used. Of course, the lifter does not have to break it down and can keep it fully assembled, but this is an option.

The system 10 can be used for the variety of exercises as already discussed. There is now discussion on a couple of the more popular exercises and how to use the system 10 to do them. A first one is the bench press. When doing the bench press, the weightlifter is laying down horizontally on the bench, the lifting bar should be located directly above the lifter's chest. The lifter will then adjust the lifting bar for the individual width of their chest size. Once they have adjusted the width, they can then lay back down on the bench and adjust the bar to the desired vertical position above the ground. Usually lifters will want the vertical height of the bar to be where their hands are just above their chest in the starting (or ground) position. When done properly, the lifting bar will be adjusted so that it will not be able to touch the lifters chest while doing the exercise because of the u-shaped portion in the lifting bar. However, while doing the bench press the lifting bar will still drop down low enough to allow the lifter to bring their hands down to just above the chest which is what most lifters want to do. The lifter will then add the desired amount of free-weights to the free-weight holders and lay back down and do their bench press exercise. While they are doing their press the entire system can be lifted into the air, and then back down again. This may take some getting used to by the lifter, but the safety benefits should outweigh the adjustment period that may be needed by the lifter.

Figure 3:
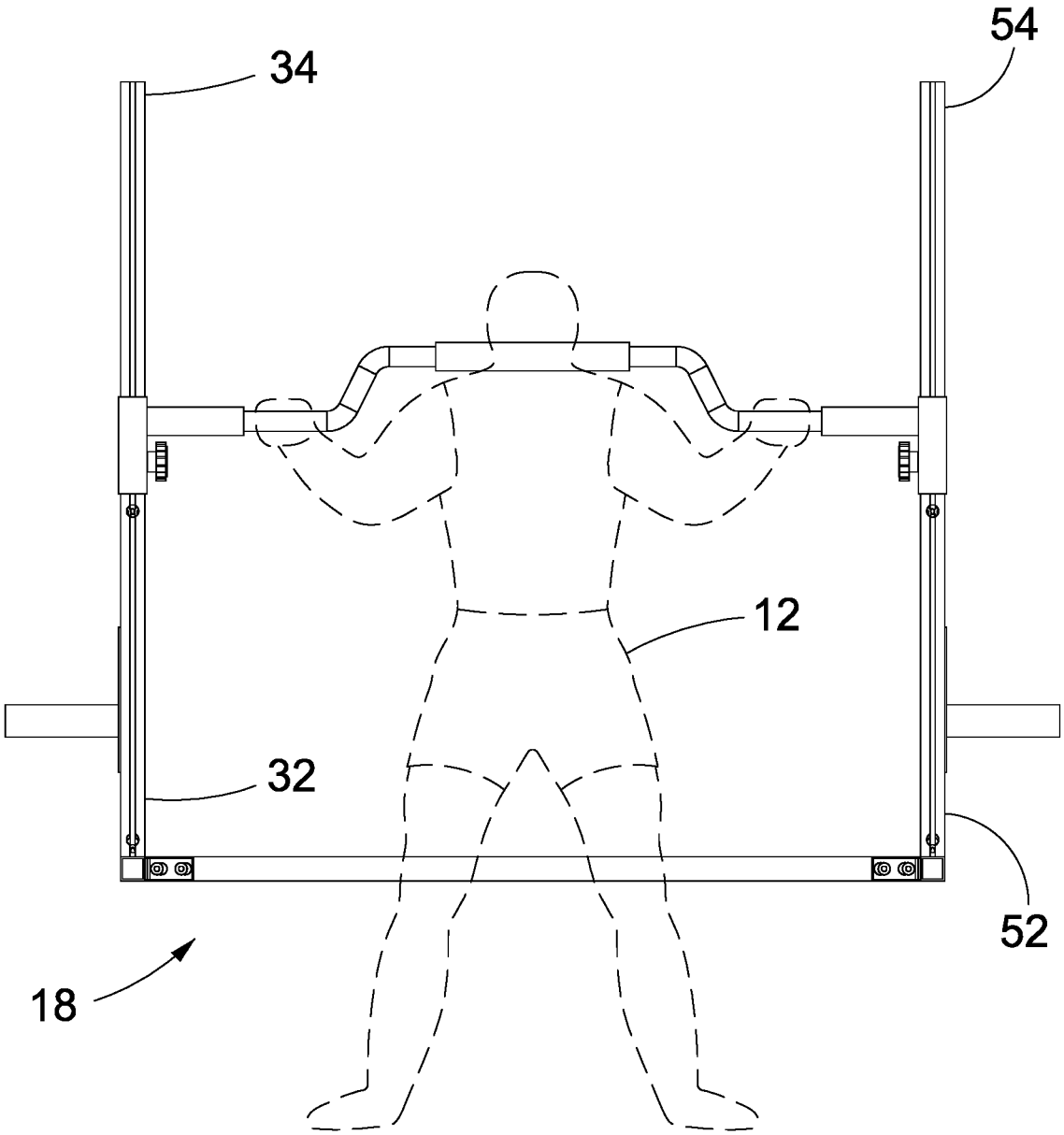
FIG. 3 is a front view of that seen in FIG. 2, now with the weightlifter engaging the free-weight lifting and support system to its lifted position.
Figure 4:
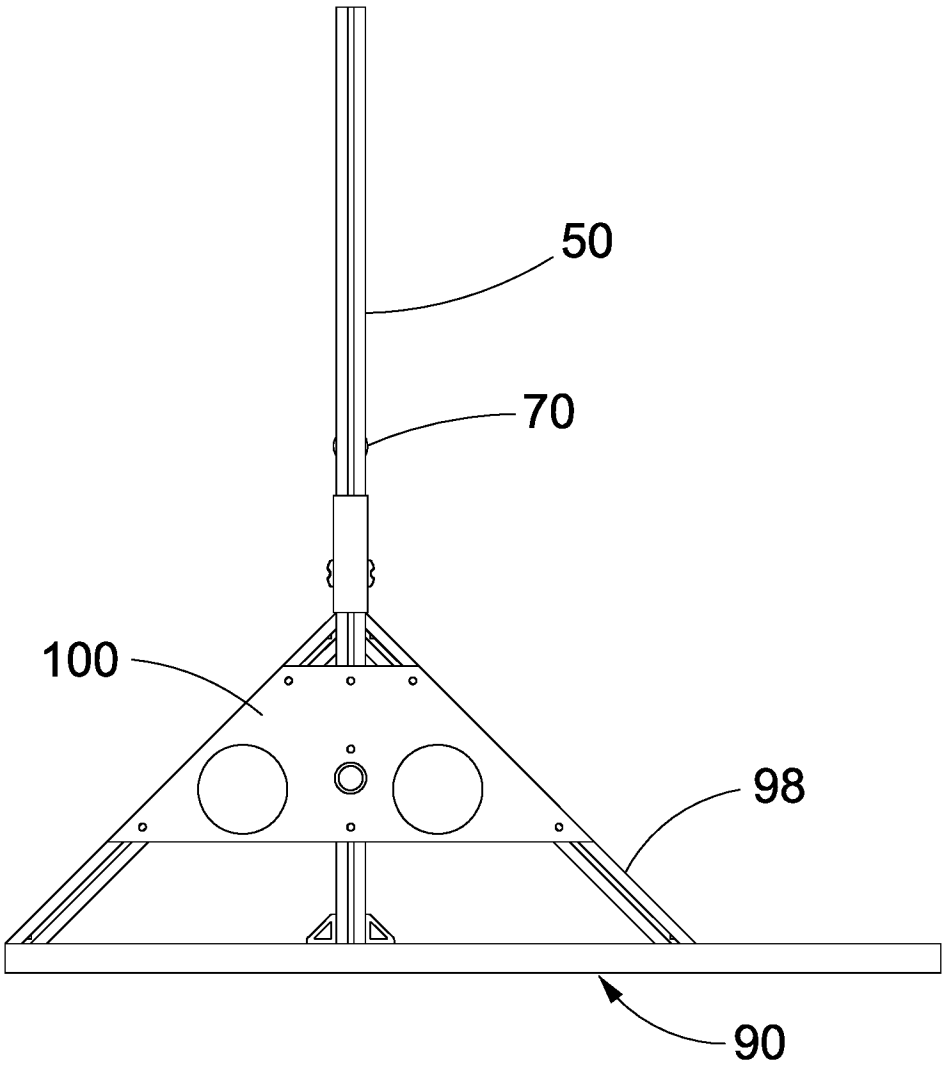
FIG. 4 is a side view of that seen in FIG. 1.
Figure 5:
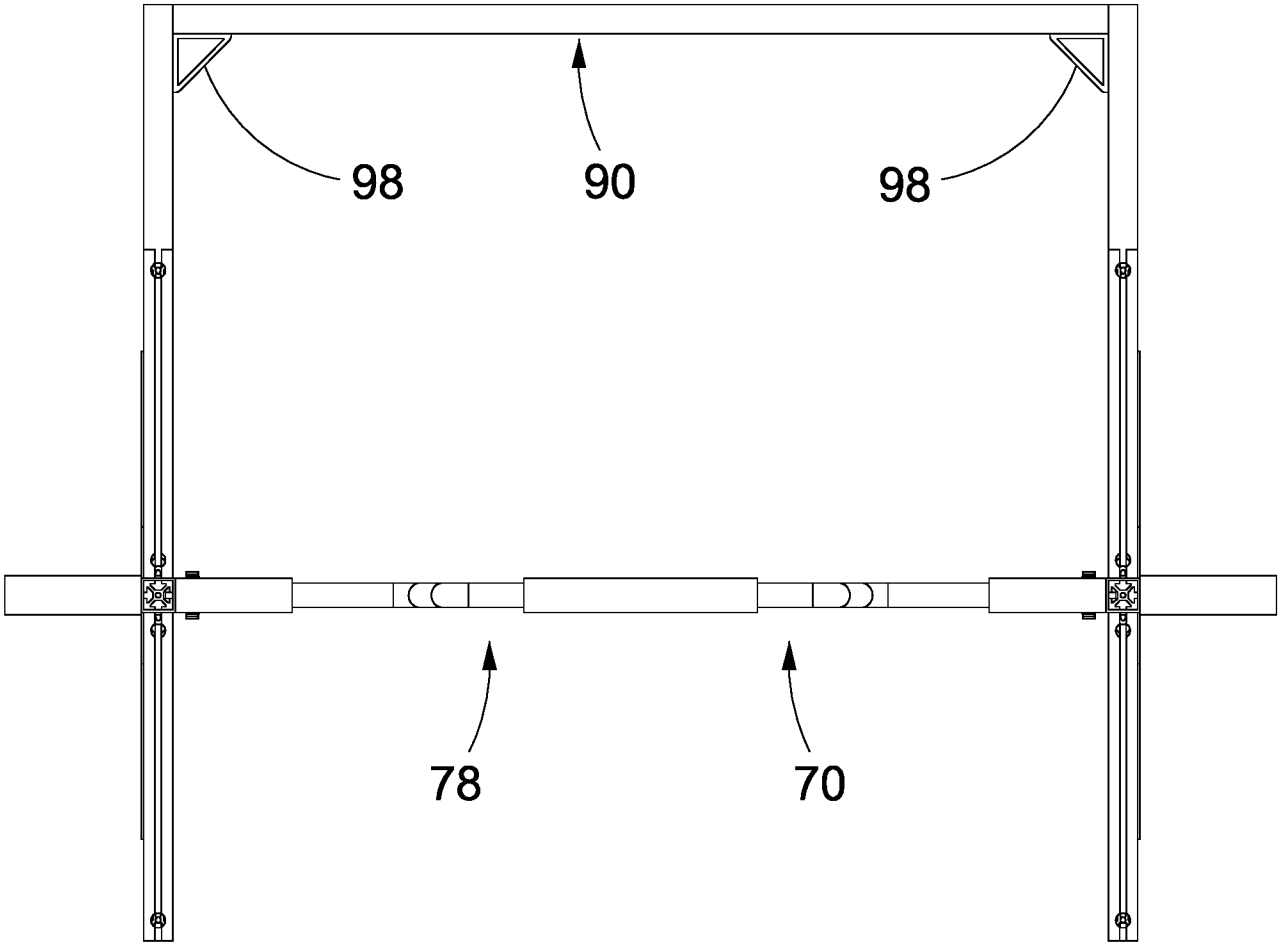
FIG. 5 is a top view of that seen in FIG. 1.

The second popular exercise is the squat/shoulder press. The system 10 can be used to do the squat (as seen in FIGS. 2 and 3). The lifting bar is connected to the side supports to allow for some movement relative thereto so that when performing the squat, the system does not have the possibility of whiplashing forward. The first thing the lifter will need to do is adjust the lifting bar to the desired width for doing squats. The lifter can then step in and put the lifting bar on their shoulders like they are doing a normal squat and adjust it to the desired starting height. The squatter will start with the bar in the lower (or ground) position of the squat. They can then add the desired number of free-weights to the weight holders and step in and do their squats. While they are doing their squats the entire system can be lifted into the air, and then back down again. This may take some getting used to by the lifter, but the safety benefits should outweigh the adjustment period that may be needed by the lifter.

As other exercise examples, there is the shoulder press, and this can be done with a simple adjustment of the lifting bar up to about the neck height of the lifter to perform that lift. For pull-ups or chin-ups, additional side support extenders (not shown) will be needed. The extenders will be added to the top ends of the side supports which will allow the lifting bar to be put high enough into the air so that the lifter can lift themselves high enough into the air. To do deadlifts, the lifter will lower the lifting bar down to the lowest position and then rotate the lifting bar either 90 or 180 degrees to do the standard deadlift.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The present system includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the packaging arts, and all such modifications and other embodiments are intended and deemed to be within the scope of the present system.

What is claimed is:

1. A free-weight lifting and safety support system used by a weightlifter comprising:

a left side support having a left base end, a left top end and a left free-weight holder;

a right side support having a right base end, a right top end and a right free-weight holder;

a lifting bar having a bar left end and a bar right end, the lifting bar located between the left side support and the right side support and separating the left side support from the right side support, wherein the lifting bar is vertically adjustable between the left base end and the left top end of the left side support at the same time as the lifting bar is vertically adjustable between the right base end and the right top end of the right side support;

wherein the lifting bar has a u-shaped portion located between the bar left end and the bar right end and the lifting bar is angularly adjustable such that the u-shaped portion can be rotated from a first fixedly-adjustable position to a second fixedly-adjustable position; and wherein the left side support is connected with the right side support via the lifting bar and a base frame attached to the left side support at the left base end and to the right side support at the right base end and aiding in separating the left side support from the right side support such that the lifting bar, the base frame, the left side support, and the right side support are together simultaneously (i) liftable from a ground position to a lifted position by the weightlifter and (ii) safely back to the ground position by the weightlifter including when a strength of the weightlifter fails.

2. The free-weight lifting and support system used by the weightlifter of claim 1, wherein the base frame is c-shaped and a portion of it extends away from the left side support and the right side support.

3. The free-weight lifting and support system used by the weightlifter of claim 1, wherein the left side support is connected with the right side support via at least the base frame.

4. The free-weight lifting and support system used by the weightlifter of claim 3, wherein each instance of connected is rigidly connected.

5. The free-weight lifting and support system used by the weightlifter of claim 1, wherein the lifting bar is adjustably attached to the left side support adjacent the bar left end and the lifting bar is adjustably attached to the right side support adjacent the bar right end.

6. The free-weight lifting and support system used by the weightlifter of claim 5, wherein the bar left end slidingly engages the left side support between the left base end and the left top end, and the bar right end slidingly engages the right side support between the right base end and the right top end.

7. The free-weight lifting and support system used by the weightlifter of claim 6, wherein the lifting bar is readily removable from the left and right side supports by sliding the bar left end up and over the left top end while sliding the bar right end up and over the right top end.

8. The free-weight lifting and support system used by the weightlifter of claim 1, wherein at least one of the left free-weight holder and the right free-weight holder is attached to its respective side support such that the at least one of the left free-weight holder and the right free-weight holder extends away from a space located between the left side support and the right side support.

9. The free-weight lifting and support system used by the weightlifter of claim 1, wherein at least one of the left free-weight holder and the right free-weight holder is a pin-like structure.

10. The free-weight lifting and support system used by the weightlifter of claim 1, wherein the lifting bar is longitudinally adjustable.

11. The free-weight lifting and support system used by the weightlifter of claim 10, wherein the bar left end is slidingly adjustable relative to the left side support and the bar right end is slidingly adjustable relative to the right side support and thereby the u-shaped portion can be longitudinally expanded and contracted.

12. The free-weight lifting and support system used by the weightlifter of claim 1, wherein each of the left side support, the right side support and the lifting bar is configured longitudinally such that each has a length dimension that is greater than a width dimension.

13. A free-weight lifting and safety support system used by a weightlifter comprising:

a left side support having a left base end, a left top end and a left free-weight holder;

a right side support having a right base end, a right top end and a right free-weight holder;

a lifting bar having a bar left end and a bar right end, the lifting bar located between the left side support and the right side support and separating the left side support from the right side support, wherein the lifting bar is vertically adjustable between the left base end and the left top end of the left side support at the same time as the lifting bar is vertically adjustable between the right base end and the right top end of the right side support;

wherein the lifting bar has a u-shaped portion located between the bar left end and the bar right end and the lifting bar is angularly adjustable such that the u -shaped portion can be rotated from a first fixedly-adjustable position to a second fixedly-adjustable position;

a base frame attached to the left side support and the right side support and aiding in separating the left side support from the right side support; and wherein the left side support is connected with the right side support via the base frame and lifting bar such that the lifting bar, the base frame, the left side support, and the right side support are together simultaneously (i) liftable from a ground position to a lifted position by the weightlifter and (ii) safely back to the ground position by the weightlifter including when a strength of the weightlifter fails.

14. The free-weight lifting and support system used by the weightlifter of claim 13, wherein the left side support is rigidly connected with the right side support via the base frame, and the base frame is attached to the left base end and to the right base end.

15. The free-weight lifting and support system used by the weightlifter of claim 13, wherein the lifting bar is adjustably attached to the left side support adjacent the bar left end and the lifting bar is adjustably attached to the right side support adjacent the bar right end, wherein the bar left end slidingly engages the left side support between the left base end and the left top end and the bar right end slidingly engages the right side support between the right base end and the right top end.

16. The free-weight lifting and support system used by the weightlifter of claim 13, wherein the lifting bar has a u-shaped portion located between the bar left end and the bar right end and is longitudinally adjustable such that the bar left end is slidingly adjustable relative to the left side support and the bar right end is slidingly adjustable relative to the right side support.

17. A free-weight lifting and support system used by a weightlifter comprising:

a left side support having a left base end, a left top end and a left free-weight holder;

a right side support having a right base end, a right top end and a right free-weight holder;

a lifting bar having a bar left end and a bar right end, the lifting bar located between the left side support and the right side support and separating the left side support from the right side support, wherein the lifting bar is vertically adjustable between the left base end and the left top end of the left side support at the same time as the lifting bar is vertically adjustable between the right base end and the right top end of the right side support;

wherein the lifting bar has a u-shaped portion located between the bar left end and the bar right end and the lifting bar is angularly adjustable such that the u-shaped portion can be rotated from a first fixedly-adjustable position to a second fixedly-adjustable position; and wherein the left side support is connected with the right side support via at least the lifting bar such that the lifting bar, the left side support, and the right side support are together simultaneously (i) liftable from a ground position to a lifted position by the weightlifter and (ii) safely back to the ground position by the weightlifter.

18. The free-weight lifting and support system used by the weightlifter of claim 17, wherein (ii) safely back to the ground position by the weightlifter includes when a strength of the weightlifter fails.

19. The free-weight lifting and support system used by the weightlifter of claim 17, further comprising a base frame attached to the left side support and the right side support and aiding in separating the left side support from the right side support.

* * * * *